United States Patent [19]

Smith

[11] Patent Number: 4,560,160

[45] Date of Patent: Dec. 24, 1985

[54] EXERCISE DEVICE FOR SWIMMERS

[76] Inventor: Brian C. Smith, 2306 Sockwell Dr., Huntsville, Ala. 35803

[21] Appl. No.: 621,447

[22] Filed: Jun. 18, 1984

[51] Int. Cl.[4] ..... A63B 21/00

[52] U.S. Cl. ..... 272/133; 272/71; 272/131

[58] Field of Search ..... 272/131, 71, 133, 61, 272/78, 112; 188/65.1–65.4; 182/190, 191, 192, 193

[56] References Cited

U.S. PATENT DOCUMENTS 3,411,776 11/1968 Holkesvick et al. ..... 272/33

3,472,510 10/1969 Holkesvick ..... 272/133

4,294,446 10/1981 Moore ..... 272/33

*Primary Examiner*—Richard J. Apley

*Assistant Examiner*—S. R. Crow

*Attorney, Agent, or Firm*—George J. Porter

[57] ABSTRACT

A rope friction resistance exercise device (10) for swimmers is disclosed. The device closely simulates the arm movements of a swimmer while using the crawl stroke. The body member (26) has a fixed crosspiece (28) attached to one end and a rotatable crosspiece (30) attached to its other end. Crosspiece (30) is held on body member (26) by retaining ring (32). Rope (12) is looped over fixed crosspiece (28) and wrapped around the body (26). The ends (22 and 24) of rope (12) are threaded through opposite sides of a square-shaped ring (34) which is attached at two points to opposite sides of rotatable crosspiece (30). Body member (26) is perforated by offset holes spaced 30 degrees apart in two rows. A detent assembly (42) located inside the rotatable crosspiece (30) latches crosspiece (30) into particular positions. The amount of friction and therefore the amount of resistance may be increased by rotating crosspiece (30) through its twelve numbered positions in increasing numerical order. A Y-shaped bracket hanger (36) is pivotally attached to fixed crosspiece (28). Bracket hanger (36) is in turn pivotally attached to wall bracket (38).

15 Claims, 19 Drawing Figures

EXERCISE DEVICE FOR SWIMMERS

TECHNICAL FIELD

The present invention relates to a friction resistance device and more particularly to an exercising device for swimmers utilizing the friction resistance principle.

BACKGROUND OF THE INVENTION

Exercise devices using a friction resistance principle are well known in the prior art. A number of these devices have been developed and used in the past, but in general they have not been completely accepted by the public. Their commercial success has been somewhat limited because of their several disadvantages, which will be discussed in more detail below.

One family of friction resistance exercising devices is shown in U.S. Pat. Nos. 3,197,204; 3,411,776; and 3,717,339, all of which issued to HOLKESVICK et al. These devices appear to have a number of characteristics which would make their operation and use less than completely satisfactory. In the HOLKESVICK et al. devices the rope 62 wraps around a solid metal shaft 22 which, because it is solid, retains and builds up heat. The rope 62 passes through slots 44 in the lower hub 40. Because the slots 44 are so small, the rope also generates a lot of heat. Certain embodiments of the device have end plugs 66 which require expensive tooling. Lastly, the adjustment of lower hub 40 can be changed only on a notch-by-notch basis, which makes it difficult to quickly change the adjustment to any desired setting.

Another friction resistance type exercising device is shown in U.S. Pat. No. 3,591,174 to SILBERMAN. This device also has a solid shaft 22 which tends to build up heat. Case 16 is in direct contact with shaft 22, enclosing the heat and directing it downward. Shaft 22 also requires elaborate and expensive tooling. Rope 32 passes through guides 34 and 38 which are only slightly larger than the rope. These guides generate heat and cause excessive wear on rope 32.

Still another friction resistance rope exercising device is shown in U.S. Pat. No. 3,782,722 to WEBB. The WEBB device also has an end knob 36 with holes 48 and 49 which are only slightly larger than the rope; thus this device tends to quickly wear out the rope and builds up excessive heat. In the WEBB device, rope 11 wraps around solid shaft 18, which again has the characteristic of retaining and building up heat. Solid shaft 18 is a part requiring elaborate and expensive tooling. Tension on rope 11 is adjustable with end knob 36, which rotates and can only change settings every 60 degrees.

Two additional rope friction exercising devices are shown in U.S. Pat. No. 3,614,098 to CARR and U.S. Pat. No. 3,674,261 to KRUG. The CARR device has an outer sleeve 11 with a wedge-shaped hollow interior and a solid wedge 21 which is insertable within the sleeve. A rope 43 passes about the solid wedge 21 so as to be frictionally engaged between the wedge 21 and the interior of the sleeve 11. This device appears to provide a structure which is impractical because of excessive wear on the rope 43. The KRUG device appears to be an elaborate device having a number of machined and threaded parts. This device appears to be expensive to manufacture and therefore would not be practical from a commercial standpoint.

Two other devices which use rope friction in a braking type device are shown in U.S. Pat. No. 536,866 to FITZ GERALD and U.S. Pat. No. 3,532,189 to WADE. The former patent to FITZ GERALD discloses a fire escape device utilizing a friction resistance principle in order to lower oneself on a rope. The latter device to WADE is an adjustable friction resistance brake device having general use as a rope exercise device or a rope brake device.

Most of the above-mentioned prior art devices are rope friction devices having solid metal parts which retain and build up heat. All of these devices have narrow channels through which the rope must pass. In all cases, this tends to wear out the rope and also to build up heat at the point where the rope passes through the opening or channel. Moreover, these prior art devices are elaborate devices having numerous parts, many of which require expensive machining and tooling. Thus, the devices are labor intensive and expensive to manufacture.

In view of the foregoing discussion it will be apparent that the prior art devices do not provide an exercise device which is particularly well suited for swimmers. Moreover, these prior art devices do not provide a rope exercise device which is simple, inexpensive to manufacture, dissipates heat well, and does not wear out the rope.

It is, therefore, an object of this invention to provide a friction resistance exercise device which causes the user to simulate the exercise obtained in swimming a crawl stroke.

It is another object of the invention to provide a friction resistance exercise device which is well engineered from the standpoint of heat dissipation and therefore has parts designed to dissipate heat and not to retain it.

It is still another object of the invention to provide a rope friction resistance exercise device which is designed to minimize wear on the rope.

It is yet another object of the invention to provide a friction resistance exercise device which is simple and has no expensive machined or threaded parts and which is easy and inexpensive to manufacture.

SUMMARY OF THE INVENTION

The present invention is a friction resistance exercise device to provide exercise for swimmers which is similar to the exercise obtained when the user swims, using the crawl stroke. The invention comprises: a main body comprising: an elongated body member, a first cylindrical crosspiece fixedly attached to one end of said body member, and a second cylindrical crosspiece rotatably attached to the opposite end of said body member; a square-shaped ring attached to said second crosspiece at two points on opposite sides of said second crosspiece; a Y-shaped bracket hanger rotatably attached to the ends of said first cylindrical crosspiece; and a rope having its central part looped over said first crosspiece, both parts of said rope adjacent to said central part being twisted about said elongated body member, one end of said rope being threaded through one side of said square-shaped ring and the other end of said rope being threaded through the opposite side of said square-shaped ring.

DETAILED DESCRIPTION OF THE INVENTION

Figure 1:
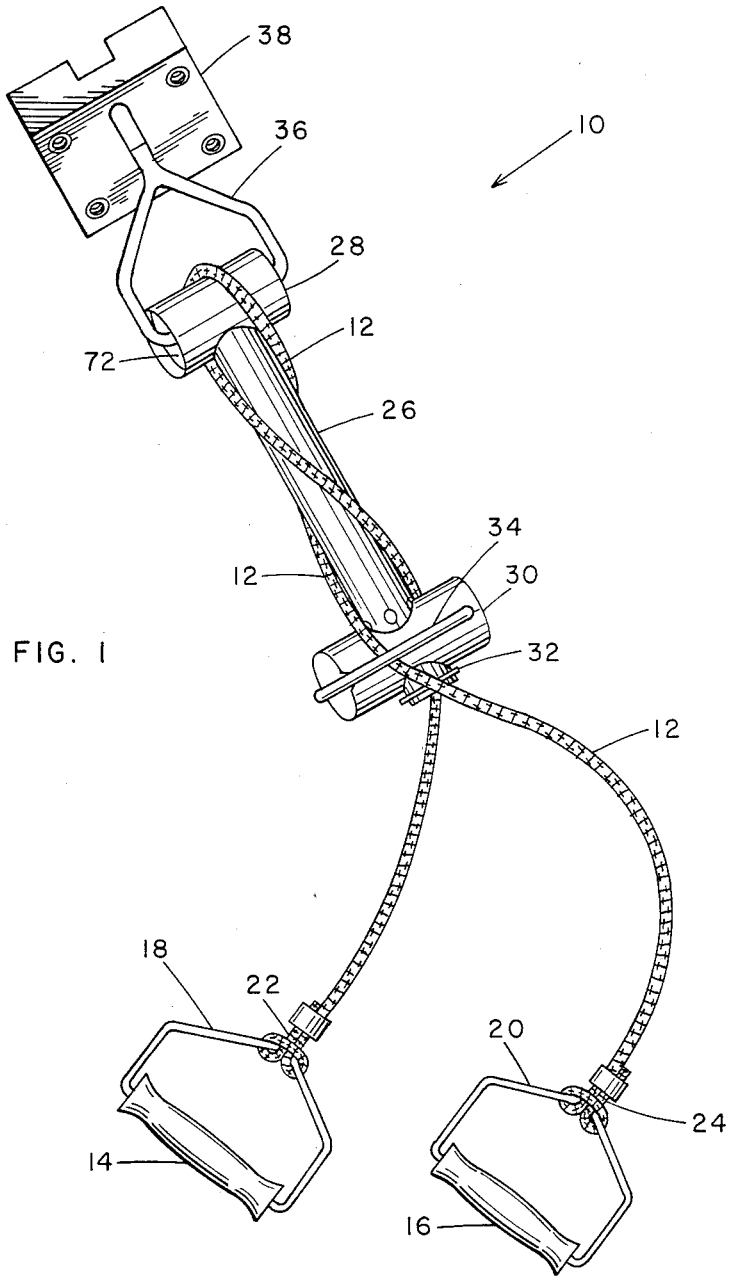
FIG. 1 is a perspective view of the invention.

The invention, shown generally by numeral 10 in FIG. 1, was developed because of a need for an exercise device which closely simulates the arm movements of a swimmer while using a crawl stroke.

As shown in the perspective view of FIG. 1, exercise device 10 has a rope 12 having two hand grips 14 and 16 fastened by D rings 18 and 20 to the ends 22 and 24, respectively, of rope 12. The body member 26 of device 10 has a fixed crosspiece 28 attached to its one end and a rotatable crosspiece 30 attached to its other end. Body member 26 and attached crosspieces 28 and 30 comprise the main body of the invention. Crosspiece 30 is held on body member 26 by retaining ring 32. Rope 12 is looped over fixed crosspiece 28 and wrapped around the body 26 of the device. The ends 22 and 24 of rope 12 are threaded through opposite sides of a square-shaped ring 34, which is attached at two points to opposite sides of rotatable crosspiece 30. A Y-shaped bracket hanger 36 is pivotally attached to fixed crosspiece 28. Bracket hanger 36 is in turn pivotally attached to wall bracket 38.

Figure 3:
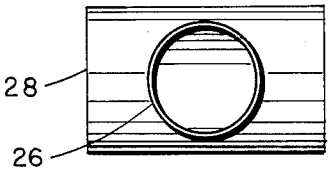
FIG. 3 is an end view of the body member shown in FIG. 2.
Figure 4:
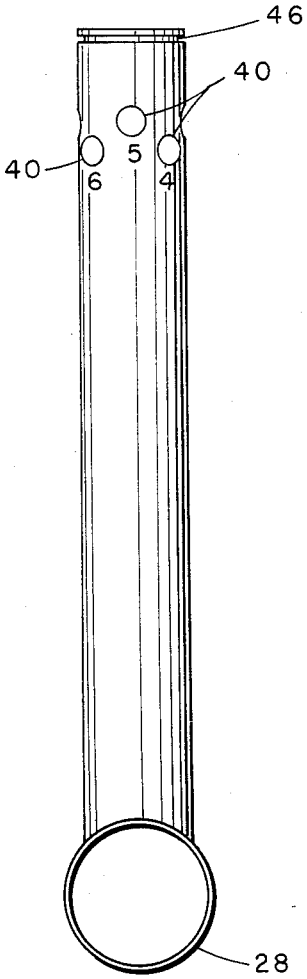
FIG. 4 is a side view of the invention shown in FIG. 2.
Figure 2:
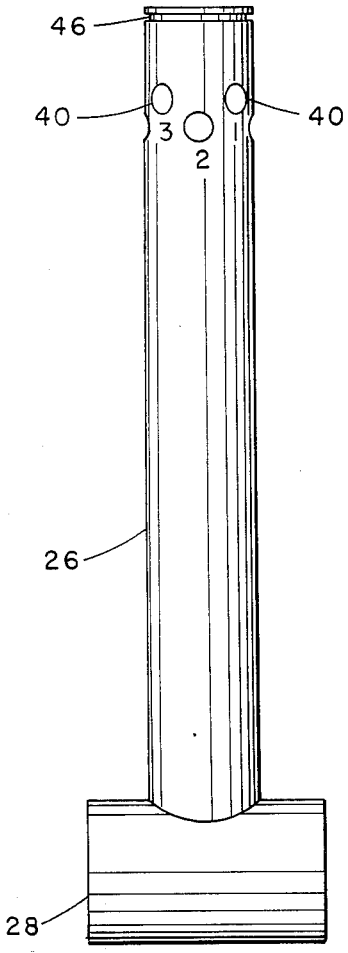
FIG. 2 is a plan view of the body member of the invention with the fixed crosspiece in position.

Looking now at FIGS. 2–4, details of the body member 26 and fixed crosspiece 28 may be seen. At the lower end of body 26, a series of alternately offset holes 40 are shown. These holes are for receiving a detent assembly 42 having a plunger 44 (see FIG. 10). Detent assembly 42 fits inside of one end of rotatable crosspiece 30. The holes 40 are positioned so that rotatable crosspiece 30 may be rotated at will and, utilizing detent assembly 42, may be firmly latched into any one of twelve numbered positions which are spaced at 30 degree intervals. At the end of body 26, annular groove 46 receives retaining ring 32 for the purpose of holding rotatable crosspiece 30 on body 26.

Figure 6:
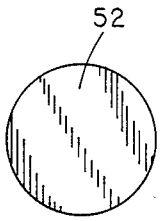
FIG. 6 is an end view of the rotatable crosspiece shown in FIG. 5.
Figure 5:
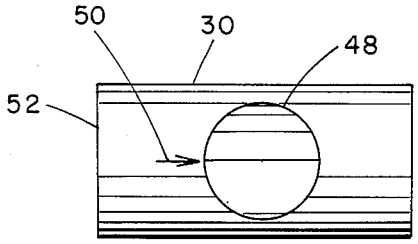
FIG. 5 is a plan view of the rotatable crosspiece.
Figure 7:
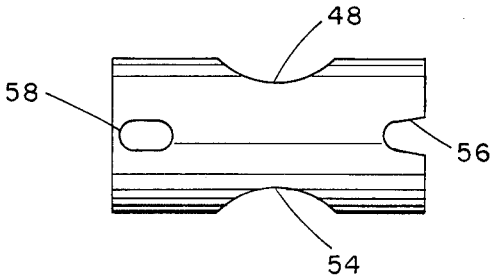
FIG. 7 is a side view of the rotatable crosspiece shown in FIG. 5.

Looking now at FIGS. 5–7, the structural details of the rotatable crosspiece 30 are shown. FIG. 5 is a plan view of crosspiece 30 showing a hole 48 in the top of crosspiece 30 and a pointer 50 etched on the top of crosspiece 30 adjacent to top hole 48. Pointer 50 indicates the number of the hole 40 (see FIG. 2) to which crosspiece 30 is latched by detent assembly 42. Holes 40 are numbered numerically from 1 to 12 and are spaced at 30 degree intervals in two rows. Even numbers are in the upper row while odd numbers are in the lower row. Therefore, when crosspiece 30 is rotated, the crosspiece 30 is also moved up or down as necessary so that the detent assembly 42 will latch into the desired hole 40. Detent assembly 42 is positioned inside crosspiece 30 in the area below pointer 50 and is held in position by a solid plug 52 across the end of crosspiece 30, as shown in FIG. 5 and the end view of FIG. 6. In the side view of crosspiece 30 shown in FIG. 7, one may see top hole 48 and lower hole 54 directly below hole 48, both for the purpose of receiving the end of body member 26. Also shown in FIG. 7 are two aligned notches 56 and two aligned slots 58 for receiving square-shaped ring 34. Slots 58 have rounded ends.

Figure 11:
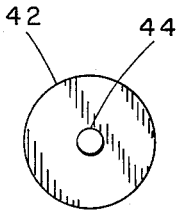
FIG. 11 is an end view of the detent shown in FIG. 10.
Figure 10:
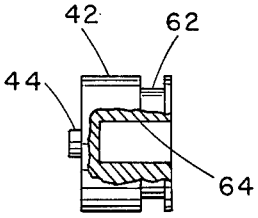
FIG. 10 is a side view of the detent for the rotatable crosspiece, shown partially in section.
Figure 13:
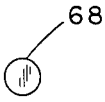
FIG. 13 is an end view of the spring shown in FIG. 12.
Figure 12:
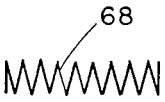
FIG. 12 is a side view of the spring for the detent shown in FIG. 10.
Figure 8:
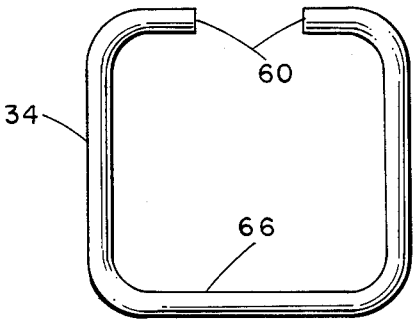
FIG. 8 is a plan view of the square-shaped ring attached to the rotatable crosspiece.
Figure 9:
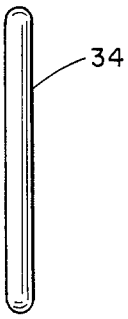
FIG. 9 is a side view of the square-shaped ring shown in FIG. 8.

In FIGS. 8–13 inclusive, there is shown the details of square-shaped ring 34 and detent assembly 42. In the plane view of ring 34 shown in FIG. 8, the two ends 60 of ring 34 may be seen. FIG. 9 is a side view of ring 34. FIG. 10 shows the details of detent assembly 42 including plunger 44, channel 62 and recess 64. The two ends 60 of ring 34 fit through the two slots 58 of crosspiece 30 and latch into channel 62 of detent assembly 42. Thus, it may be seen that square-shaped ring 34 is fastened directly to detent assembly 42 and thus indirectly to crosspiece 30, since detent assembly 42 is held inside crosspiece 30. The center portion 66 of ring 34 fits into (and rides up and down in) the two aligned notches 56 of crosspiece 30. FIG. 11 is an end view of detent assembly 42 looking directly at plunger 44. Detent assembly 42 is spring-loaded; FIGS. 12 and 13 respectively show a side view and an end view of the spring 68 for the detent assembly 42. When crosspiece 30 needs to be rotated to increase tension on rope 12, one pushes on the center 66 of ring 34 to release spring loaded detent assembly 42. One then rotates crosspiece 30 until pointer 50 indicates the desired setting and plunger 44 snaps into position in the corresponding hole 40.

Figure 14:
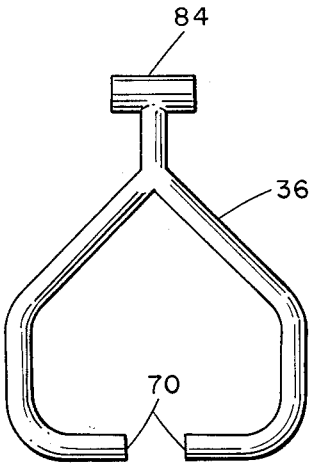
FIG. 14 is a plan view of the Y-shaped bracket hanger used to attach the main portion of the invention to a wall.
Figure 15:
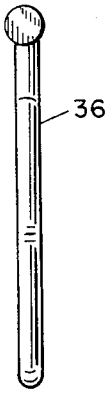
FIG. 15 is a side view of the bracket hanger shown in FIG. 14.
Figure 16:
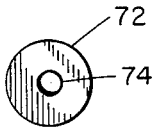
FIG. 16 is an end view of the bushing which fits inside the fixed crosspiece and receives the two prong ends of the bracket hanger shown in FIG. 14.
Figure 17:
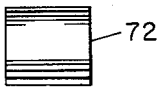
FIG. 17 is a side view of the bushing shown in FIG. 16.

As indicated previously, Y-shaped bracket hanger 36 is rotatably attached to fixed crosspiece 28. FIGS. 14 and 15 show plan and side views respectively of bracket hanger 36. FIGS. 16 and 17 show an end view and a side view respectively of a bushing 72 (also see FIG. 1) which fits inside the fixed crosspiece 28 and receives the two prong ends 70 of bracket hanger 36. Prong ends 70 fit into holes 74 at either end of bushing 72. Bushing 72 is preferably made of nylon, polyethylene or some similar form of plastic.

Figure 18:
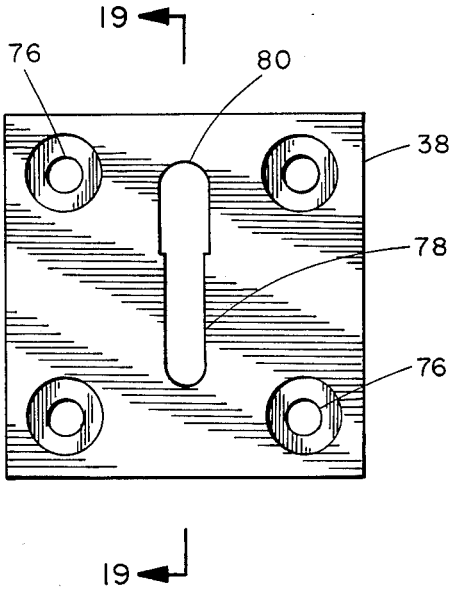
FIG. 18 is a plan view of the wall bracket used to hold the bracket hanger shown in FIG. 14.
Figure 19:
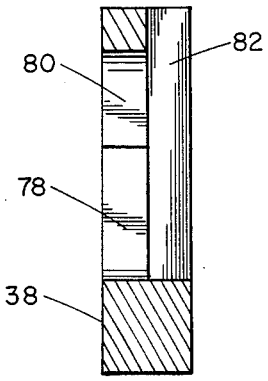
FIG. 19 is a sectional view of the bracket shown in FIG. 18, taken along line 19—19 of FIG. 18.

FIG. 18 shows wall bracket 38 which holds the Y-shaped bracket hanger 36 shown in FIG. 14. Bracket 38 may be attached to a wall by the use of four screwholes 76. Bracket 38 has a vertical center slot 78 having a slightly enlarged upper portion 80. Directly below slot 78 and extending upward to the top of bracket 38 is a channel 82. Y-shaped bracket hanger 36 is attached to bracket 38 by turning hanger 34 so that fixed end fitting 84 is vertical and by slipping end fitting 84 through enlarged slot 80 and into channel 82. Hanger 36 is then turned 90 degrees and end fitting 84 is pulled downward in channel 82. Hanger 36 is now firmly and rotatably attached to bracket 38 and end fitting 84 is held by the sides of slot 78. FIG. 19 is a sectional view of wall bracket 38, taken along line 19—19 of FIG. 18.

Exercise device 10 is operated by fastening crosspiece 28 to a wall or other support by use of hanger 36 and bracket 38. The person utilizing the device then grasps hand grips 14 and 16 and alternately pulls on one hand grip and then the other. The rope 12 rubbing against body 26 generates considerable friction and resistance, which provides exercise to the user similar to the exercise received by a swimmer stroking through the water. The amount of friction (and therefore the amount of resistance and exercise) may be increased as desired by rotating crosspiece 30 through its twelve numbered positions in increasing numerical order. This causes more of rope 12 to twist around body 26 and therefore puts more of the rope 12 in contact with body 26, thus increasing the friction and resistance and requiring more force to be exerted by the user.

From the above, it may be seen that the invention provides a friction resistance exercise device for swimmers which simulates the exercise obtained in swimming a crawl stroke. Unlike other friction resistance devices shown in the prior art, this device is made of lightweight tubing and dissipates heat extremely well. Moreover, it is designed to minimize wear on the rope. The device has no expensive machined or threaded parts, and it is easy and inexpensive to manufacture.

What is claimed is:

1. A friction resistance exercise device for swimmers comprising:
- a main body comprising:
  - an elongated body member,
  - a first cylindrical crosspiece fixedly attached to one end of said body member, and
  - a second cylindrical crosspiece rotatably attached to the opposite end of said body member;
- a square-shaped ring attached to said second crosspiece at two points on opposite sides of said second crosspiece;
- a Y-shaped bracket hanger rotatably attached to the ends of said first cylindrical crosspiece; and
- a rope having its central portions looped over said first crosspiece, and having rope portions adjacent to said central portion being twisted about said elongated body member, one end of said rope being threaded through one side of said square-shaped ring and the other end of said rope being threaded through the opposite side of said square-shaped ring.

2. The friction resistance exercise device for swimmers as set forth in claim 1 wherein said second cylindrical crosspiece comprises two aligned holes positioned in the top surface and bottom surface respectively of said second cylindrical crosspiece, for receiving said opposite end of said body member.

3. The friction resistance exercise device for swimmers as set forth in claim 2 comprising an annular groove in the outside surface of said body member, near said opposite end of said body member.

4. The friction resistance exercise device for swimmers as set forth in claim 3 comprising a retaining ring which snaps into said annular groove and holds said second crosspiece on said body member.

5. The friction resistance exercise device for swimmers as set forth in claim 1 comprising a spring-loaded cylindrical detent assembly mounted inside of one end of said second crosspiece, said detent assembly comprising:
- a fixed plunger mounted at the center of one end of said detent assembly;
- a cylindrical recess at the center of the other end of said detent assembly;
- an annular groove cut around the exterior surface of said cylindrical detent assembly, near said other end of said detent assembly; and
- a coil spring mounted in said cylindrical recess.

6. The friction resistance exercise device for swimmers as set forth in claim 5 wherein said second crosspiece comprises a solid plug inserted in one end of said second crosspiece for retaining said detent assembly inside said second crosspiece.

7. The friction resistance exercise device for swimmers as set forth in claim 6 wherein said square shaped ring has an opening on one of its sides and has two spaced prong ends defining said opening.

8. The friction resistance exercise device for swimmers as set forth in claim 7 wherein said second crosspiece comprises two aligned slots located on opposite sides of said second crosspiece, near one end of said second crosspiece and two aligned notches in the opposite end of said second crosspiece, said aligned notches being located on opposite sides of said second crosspiece.

9. The friction resistance exercise device for swimmers as set forth in claim 8 wherein said square-shaped ring is attached to said detent assembly, each of said two prong ends of said square-shaped ring extending through one of said two aligned slots in said second crosspiece, said two prong ends of said square-shaped ring also extending into said annular groove around said detent assembly, said two prong ends being retained in said annular groove.

10. The friction resistance exercise device for swimmers as set forth in claim 9 wherein the side of said square-shaped ring opposite the side having said opening extends through said two aligned notches in said second crosspiece.

11. The friction resistance exercise device for swimmers set forth in claim 10 wherein said body member is perforated by a series of spaced holes, said holes being located on said opposite end of said body member, near said annular groove.

12. The friction resistance exercise device for swimmers as set forth in claim 11 wherein said series of holes comprises twelve holes spaced at 30 degree intervals.

13. The friction resistance exercise device for swimmers as set forth in claim 12 wherein said series of holes are arranged in two rows around the circumference of said body member and adjacent holes are offset so that each hole is located in a different row than its immediately adjacent holes;
- whereby said detent plunger may engage any one of said series of holes, thereby latching said second crosspiece in a particular position, and said detent plunger may be released from engagement with any one of said holes by pushing on said square-shaped ring, thereby compressing said detent spring and thus allowing said second crosspiece to be rotated to a new position.

14. The friction resistance exercise device for swimmers as set forth in claim 1 comprising a wall bracket having a central slot and wherein the Y-shaped bracket hanger has an end fitting arranged to mate with said central slot of said wall bracket, whereby said Y-shaped bracket hanger may be rotatably attached to said wall bracket.

15. The friction resistance exercise device for swimmers as set forth in claim 1 comprising two "D" ring handles, each said handle being attached to one of said ends of said rope, each said handle having a round handgrip rotatably attached to said handle.

* * * * *